US007137848B1

(12) United States Patent
Trout et al.

(10) Patent No.: US 7,137,848 B1
(45) Date of Patent: Nov. 21, 2006

(54) MODULAR CONNECTOR FAMILY FOR BOARD MOUNTING AND CABLE APPLICATIONS

(75) Inventors: David Allison Trout, Lancaster, PA (US); Richard Nicholas Whyne, Camp Hill, PA (US); Michael Allen Blanchfield, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/289,137

(22) Filed: Nov. 29, 2005

(51) Int. Cl.
*H01R 13/58* (2006.01)

(52) U.S. Cl. ..... 439/465; 439/170; 439/630; 439/947

(58) Field of Classification Search ..... 439/629–630, 439/78, 170, 218, 465, 682, 687, 947, 731
See application file for complete search history.

(56) References Cited

U.S. PATENT DOCUMENTS 5,118,306 A 6/1992 Bixler et al.
5,195,909 A * 3/1993 Huss et al. ..... 439/465
5,676,569 A * 10/1997 Davis ..... 439/731
6,293,829 B1 9/2001 Qiao et al.
6,506,081 B1 1/2003 Blanchfield et al.
6,887,098 B1 * 5/2005 Luo et al. ..... 439/540.1
6,887,108 B1 * 5/2005 Wu ..... 439/638
6,984,151 B1 * 1/2006 Wu ..... 439/610
7,021,959 B1 * 4/2006 Tsuji et al. ..... 439/470
7,059,892 B1 * 6/2006 Trout ..... 439/465
2003/0087539 A1 * 5/2003 Burmeister ..... 439/78

* cited by examiner

*Primary Examiner*—Michael C. Zarroli

(57) ABSTRACT

A connector family that has a central housing having a connector mating face and a board mounting interface. An outer shell is shaped to fit over the central housing. The outer shell at least partially encloses the board mounting interface and exposes the connector mating interface of the central housing. The outer shell has a cable interface that is configured to be joined to a cable. Contacts are held in the central housing. The contacts, central housing and outer shell are used in different configurations depending upon the application. In a first application, the outer shell is mounted over the central housing to form a first configuration. In a second application, the outer shell is removed to expose the board mounting interface on the central housing to form a second configuration.

17 Claims, 8 Drawing Sheets

MODULAR CONNECTOR FAMILY FOR BOARD MOUNTING AND CABLE APPLICATIONS

BACKGROUND OF THE INVENTION

The present invention generally relates to a modular connector family, and more specifically to a connector family having common components that may be used in both board mounting and cable applications.

A wide variety of connectors exist today for various applications. For example, connectors are used to join circuit boards, to join cables, to join cables and circuit boards and the like. In general, each type of connector is designed for a specific application, and the overall construction of a connector is both tailored and streamlined for use in a given application. Most applications have different physical design and performance requirements. Thus, a connector designed for a board mounting application is optimized for the constraints and performance requirements of the board mounting application. Separately, a connector intended for a cable application is optimized to satisfy the physical and performance requirements of the cable application.

Once a particular connector is designed for a given application, dedicated tooling is then constructed to produce the particular connector in large volume. In general, the tooling associated with conventional board mounted connectors will be quite different from the tooling associated with conventional cable connectors. Hence, separate tooling must be constructed and maintained for each type of connector. Separate tooling for each type of connector adds to the overall cost associated with production.

A need remains for a combination of connector components that form a connector family capable of satisfying diverse applications, such as board mounting and cable applications with numerous patterns of signal and power contacts.

BRIEF DESCRIPTION OF THE INVENTION

In accordance with an embodiment, a connector family is provided that comprises a central housing having a connector mating face and a board mounting interface. An outer shell is shaped to fit over the central housing. The outer shell at least partially encloses the board mounting interface and exposes the connector mating interface of the central housing. The outer shell has a cable interface that is configured to be joined to a cable. Contacts are held in the central housing. The contacts, central housing and outer shell are used in different configurations depending upon the application. In a first application, the outer shell is mounted over the central housing to form a first configuration. In a second application, the outer shell is removed to expose the board mounting interface on the central housing to form a second configuration.

Optionally, the connector family may include first and second sets of contacts associated with the first and second configurations, respectively, where the second set of contacts is loaded in the central housing to be board mounted. The second set of contacts are replaced with the first set of contacts when the outer shell is provided over the central housing to form a cable assembly. Optionally, the first set of contacts may include wire crimps configured to securely grip cables and the contacts in the second set of contacts may include contact tails configured to be secured to a circuit board. The first set of contacts may be provided in the central housing for use only in the first application and not in the second application, while the second set of contacts may be provided in the central housing for use only in the second application and not in the first application.

Optionally, the central housing may include an interior cavity with a back wall having contact retention openings therethrough. The contact retention openings may be molded in one of different first and second patterns corresponding to the first and second configurations, respectively. The central housing may retain a common outer envelope for use in both of the first and second configurations, but have different first or second contact patterns provided within the back wall depending upon the intended application.

DETAILED DESCRIPTION OF THE INVENTION

Embodiments of the present invention generally relate to connector families having multiple separable components. The components are joined in different combinations and contact patterns depending upon the intended application. A single connector family may support two or more applications. In certain embodiments described hereafter, exemplary applications include board mounting and cable assemblies, but other applications may apply. In certain embodiments, the connector family includes a common central housing (FIGS. 1, 2, 5, 6, 9 and 10) having a removable outer shell (FIGS. 1 and 2), and different sets of signal and power contacts (FIGS. 1–10). It is understood, that the components in FIGS. 1–10 form various combinations of connector families and need not all be available to form a single connector family.

Figure 1:
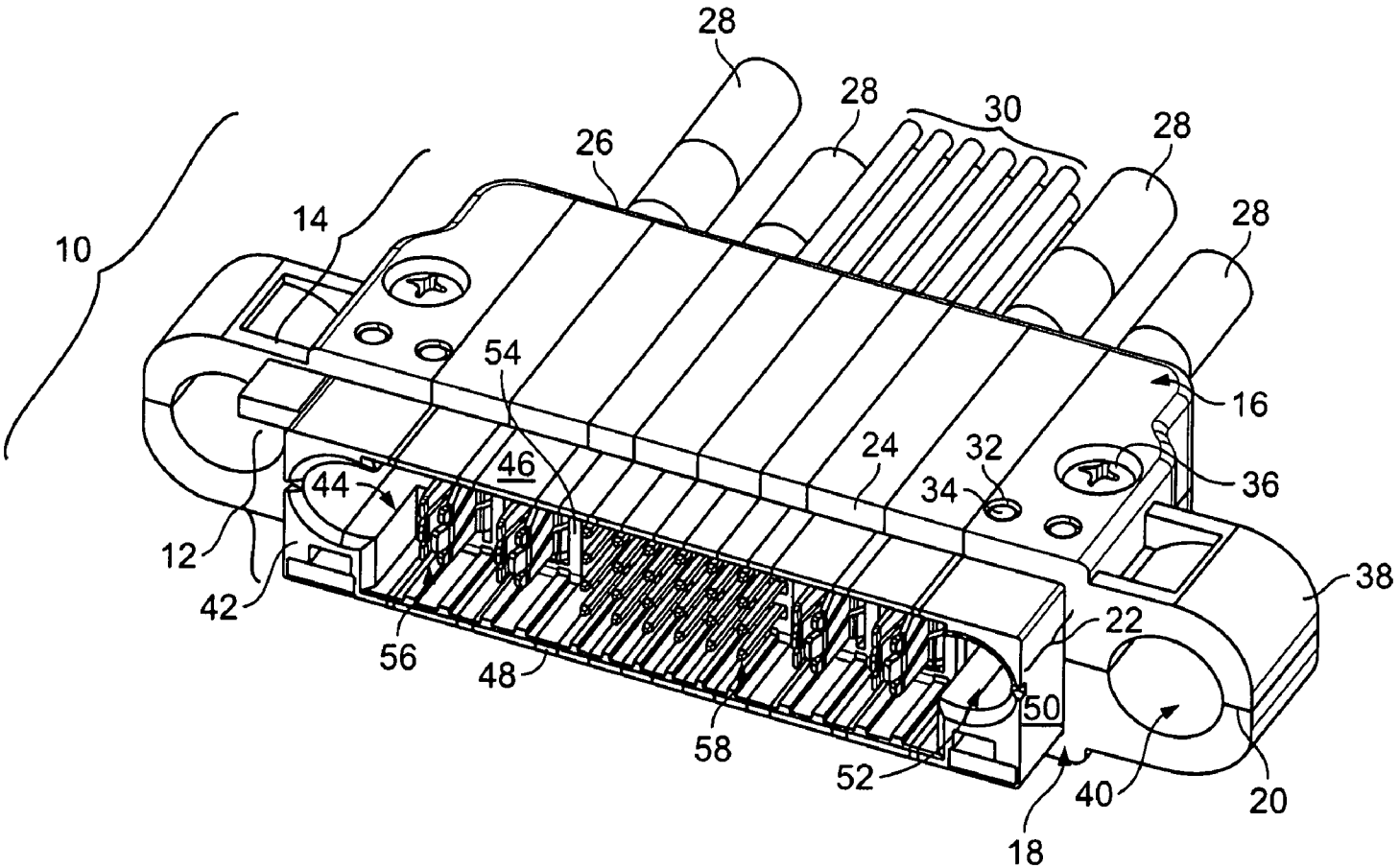
FIG. 1 illustrates a front isometric view of a cable assembly formed in accordance with an embodiment of the present invention.

FIG. 1 illustrates a cable assembly 10 formed from one connector family in accordance with an embodiment of the present invention and assembled for a cable application. The cable assembly 10 includes a central housing 12 (also referred to as a header) that is held within an outer shell 14 formed from upper and lower half shells 16 and 18. The upper and lower half shells 16 and 18 join at a seam 20 to partially enclose the central housing 12. The central housing 12 includes a lead portion 22 that is exposed and extends from a front face 24 of the outer shell 14. The outer shell 14 also includes a rear face 26 that is configured to receive power and signal wires or cables 28 and 30, respectively. The upper and lower half shells 16 and 18 include openings 32 therethrough that align with, and accept, attachment posts 34 that are formed on, and extend upward and downward, from the central housing 12. Screws 36 securely retain the upper and lower half shells 16 and 18 together over the central housing 12. Opposite ends of the outer shell 14 include retention sockets 38 with openings 40 therethrough that are configured to accept fasteners to retain the cable assembly 10 with a mating connector.

The central housing 12 includes an interior cavity 44 that opens onto a connector mating face 42. The interior cavity 44 is surrounded by top, bottom and end walls 46, 48 and 50 that collectively define an outer envelope of the central housing 12. Alignment slots 52 are provided at opposite ends of the interior cavity 44 to receive pins during a mating operation in order to correctly align the cable plug assembly 10 with a mating connector. The interior cavity 44 has an interior contour and is closed by a back wall 54 that retains power and signal contacts 56 and 58, respectively, in a desired predetermined contact pattern.

Exemplary alternative structures of the cable assembly, central housing and contacts are illustrated in co-pending application Ser. No. 11/022, 528 filed on Dec. 23, 2004 and titled "Electrical Connector and Backshell", the complete subject matter of which is expressly incorporated herein in its entirety by reference.

Figure 2:
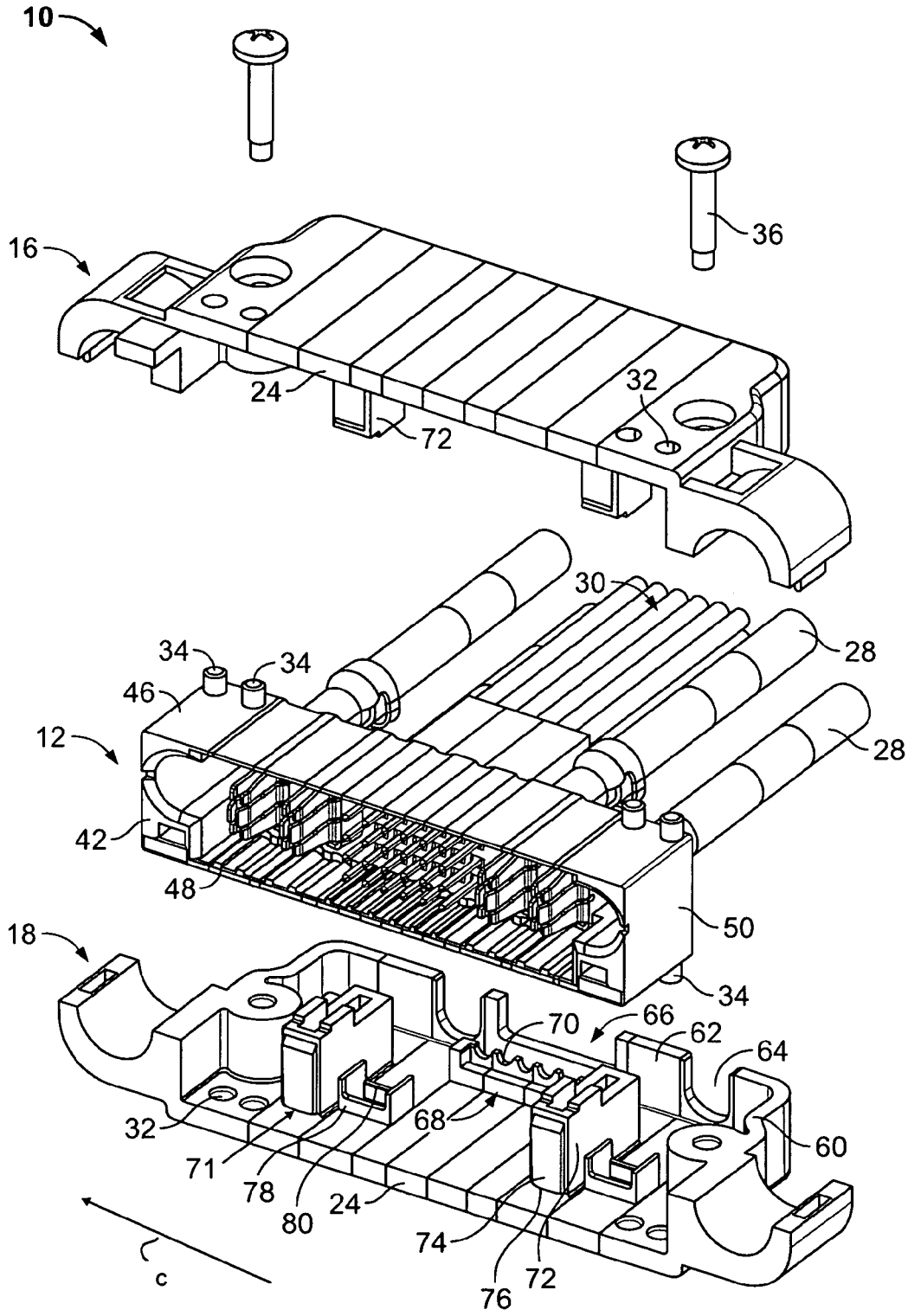
FIG. 2 illustrates an exploded isometric view of the cable assembly of FIG. 1.

FIG. 2 illustrates an exploded view of the cable assembly 10 of FIG. 1. The upper and lower half shell 16 and 18 have been separated to better illustrate the individual components. The top and bottom walls 46 and 48 and end walls 50 of the central housing 12 are generally planar to form a rectangular block outer envelope. The attachment posts 34 extend upward and downward from the top and bottom walls 46 and 48, respectively. The attachment posts 34 align with the openings 32 in the upper and lower half shell 16 and 18. The upper and lower half shell 16 and 18 have interior features that substantially mirror one another. Thus, the interior of the upper half-shell 16 is not illustrated in detail. Each of the upper and lower half shell 16 and 18 include a front face 24, sides 60 and a rear wall 62. The rear wall 62 includes notched out portions 64 and 66 that are shaped to receive corresponding power and signal wires or cables 28 and 30. An extension bracket 68 is located within each of the upper and lower half shell 16 and 18. The extension bracket 68 includes curved wire clearance slots 70. When the upper and lower half shell 16 and 18 are joined together, the notched out portions 64 and the wire clearance slots 70 form nests that properly locate power and signal cables 28 and 30, respectively.

The lower half shell 18 includes a plurality of organizing elements 71 that are arranged in a transverse row in the direction of the arrow C. The organizing elements 71 include alternating terminal cradle elements 78 and terminal retention elements 72. A similar row of organizing elements is formed in the upper half shell 16. The terminal cradle elements 78 and the terminal retention elements 72 in the upper half shell 16 are offset transversely from like organizing elements in the lower half shell 18. That is, each terminal cradle element 78 in the lower half shell 18 is vertically aligned with one of the terminal retention elements 72 in the upper half shell 16 and transversely offset from a terminal cradle element 78 in the upper half shell 16. The same relationship exists with regard to the terminal retention elements 72.

Figure 3:
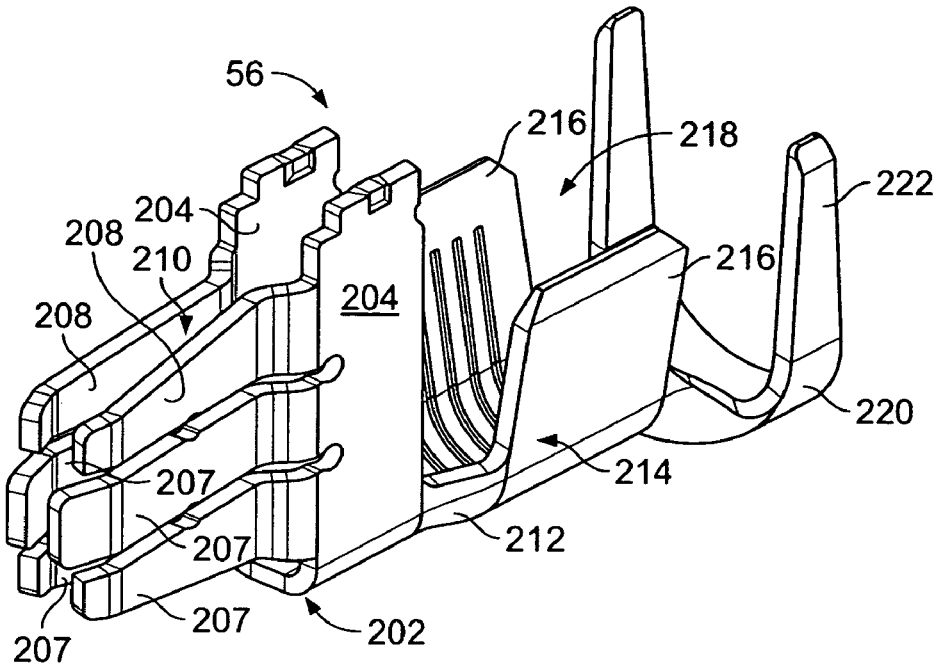
FIG. 3 illustrates an isometric view of a cable contact formed in accordance with an embodiment of the present invention.

FIG. 3 illustrates an isometric view of a power contact 56 held in the central housing 12 of FIG. 1. The power contact 56 may be stamped and formed from a unitary piece of stock. The power contact 56 includes a U-shaped body 202 that includes parallel aligned side sections 204. Each side section 204 includes a series of contact beams 206–208 extending forward therefrom and aligned with one another. Opposed contact beams 206–208 are separated by a gap 210. The body 202 is formed integrally at a base section 212 with a flared wire crimping element 214. The wire crimping element 214 includes sides 216 that are separated to form a wire retention area 218 therebetween. The base section 212 is also formed integrally with an insulation crimp element 220 having opposed legs 222 that are configured to be wrapped about insulation upon a wire or cable when a conductive portion of the wire or cable is placed inside of the wire retention area 218.

Figure 4:
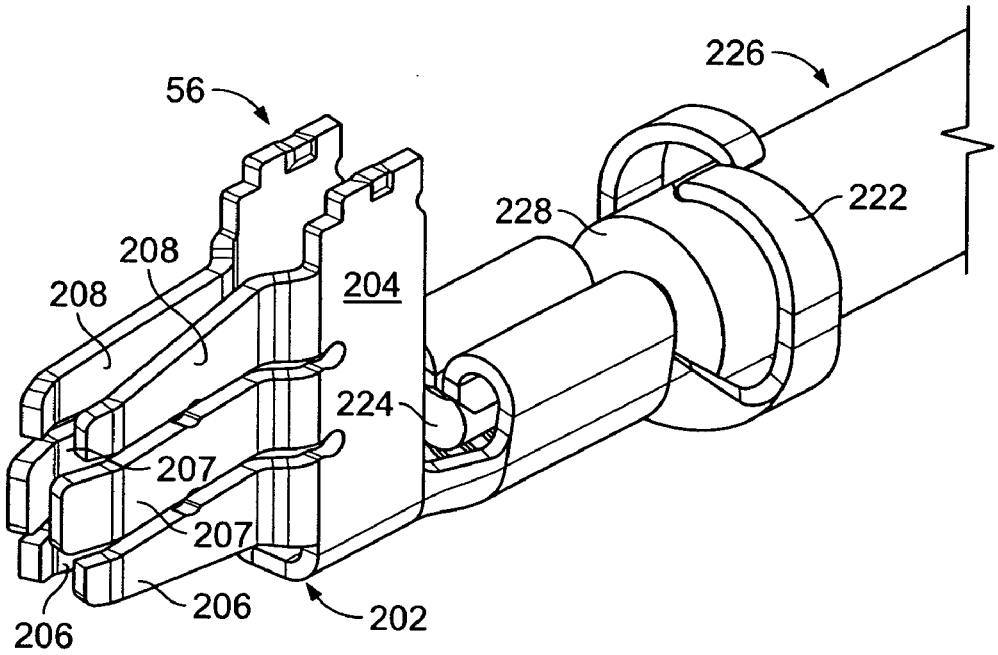
FIG. 4 illustrates the cable contact of FIG. 3 crimped to a wire cable.

FIG. 4 illustrates the power contact 56 of FIG. 3 with a conductive wire securely crimped therein. As shown in FIG. 4, the sides 216 of the wire crimping element 214 are bent until securely engaging and retaining a conductor 224 of the power cable 226. The legs 222 are also firmly wrapped about and securely engage the insulator 228 on the power cable 226.

Figure 5:
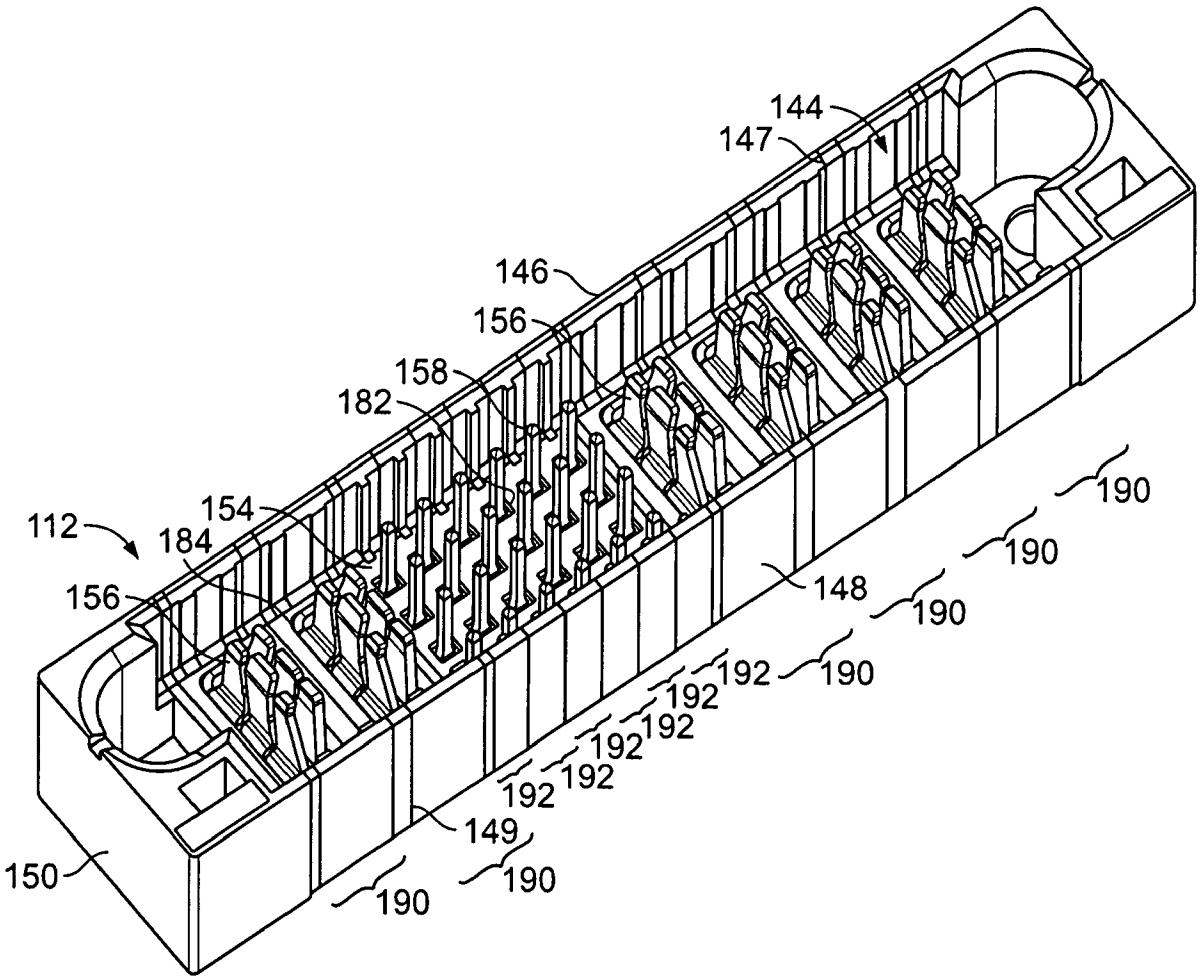
FIG. 5 illustrates a top view of a central housing utilized in the cable assembly of FIG. 1.

FIG. 5 illustrates an isometric view of a central housing 112 formed in accordance with a desired application and contact pattern. The central housing 112 includes top, bottom and end walls 146, 148 and 150 that define the interior cavity 144. The back wall 154 includes a plurality of signal contact and power contact openings 182 and 184, respectively, formed therethrough. In the example of FIG. 5, the signal contact openings 182 are arranged in a four by six pattern and each retains an individual signal contact 158 securely therein. In the example of FIG. 5, the contact configuration is provided with a group of signal contacts 158 formed in a four by six pattern, with a pair of power contacts 156 provided on one side and four power contacts 156 provided on the opposite side. It is understood that one or more of the power contacts 156 may represent a ground contact, and more or fewer power and signal contacts 156 and 158 may be used.

The top and bottom walls 146 and 148 include a series of lines 147 and 149, respectively. The lines 147 and 149 represent virtual modular demarcation lines denoting separate mold inserts that are placed into a molding tool to define the various patterns of signal and power contact openings 182 and 184. The lines 147 and 149 do not represent structural aspects of the central housing 112. For example, separate power contact mold inserts may be loaded into the mold tool for each section denoted by reference numeral 190 and for each section denoted by reference numeral 192. The tool insert sections 190 correspond to power contact openings 184, while the tool insert sections 192 correspond to signal contact openings 182. The combination and configuration of tool inserts may be varied depending upon the particular application for which the central housing 112 is intended.

Figure 6:
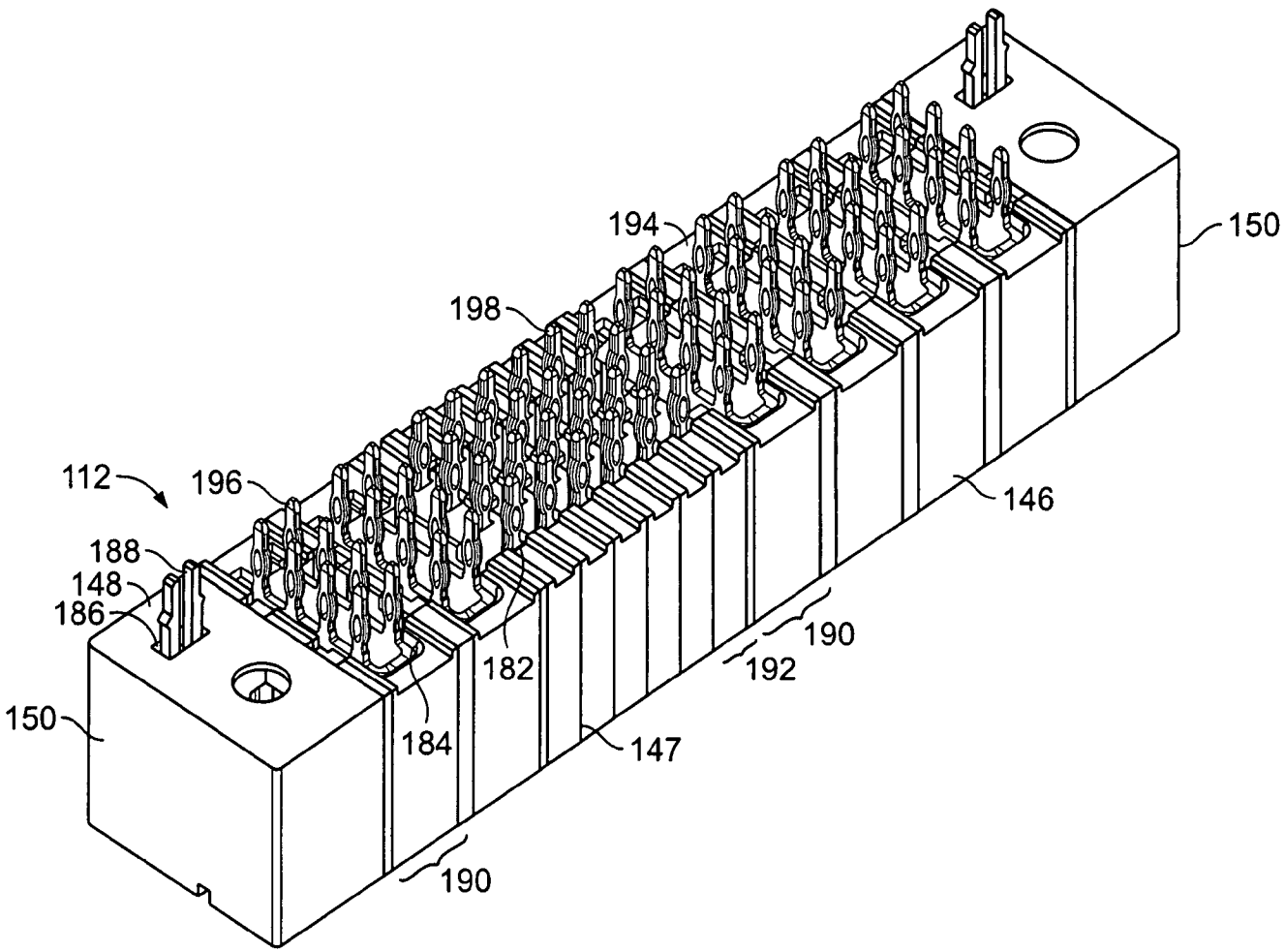
FIG. 6 illustrates a bottom view of the central housing of FIG. 5.

FIG. 6 illustrates a rear isometric view of the central housing 112 of FIG. 5. The central housing 112 includes a board mounting interface 194 that is generally planar. The signal and power contact openings 182 and 184 extend from the interior cavity 144 (FIG. 5) through the back wall 154 to the board mounting interface 194. In the example of FIG. 6, the power and signal contacts 156 and 158 (FIG. 5) include power and signal contact tails 196 and 198, respectively, projecting from the board mounting interface 194. The power and signal contact tails 196 and 198 are configured as "eye of the needle" pins to be press-fit into holes (e.g., vias) in a circuit board (e.g., a printed circuit board). In the example of FIG. 6, each power contact 156 (FIG. 5) includes a group of eight power contact tails 196 formed integrally therewith, although fewer or more power contact tails 196 may be used. Each signal contact 158 (FIG. 5) includes a corresponding single signal contact tail 198 extending from the board mounting interface 194, although more than one signal contact tails 198 may be used with each signal contact 158.

The central housing 112 also includes latch openings 186 provided therethrough and located proximate opposite end walls 150. The latch openings 186 receive latch elements 188 that are configured to snappably engage within mating latch features provided on the circuit board, to which the central housing 112 is mounted. Similar to FIG. 5, FIG. 6 illustrates the lines 147 that separate the tool insert sections 190 and 192. The lines 147 may not necessarily appear on the central housing 112 once molded.

Figure 7:
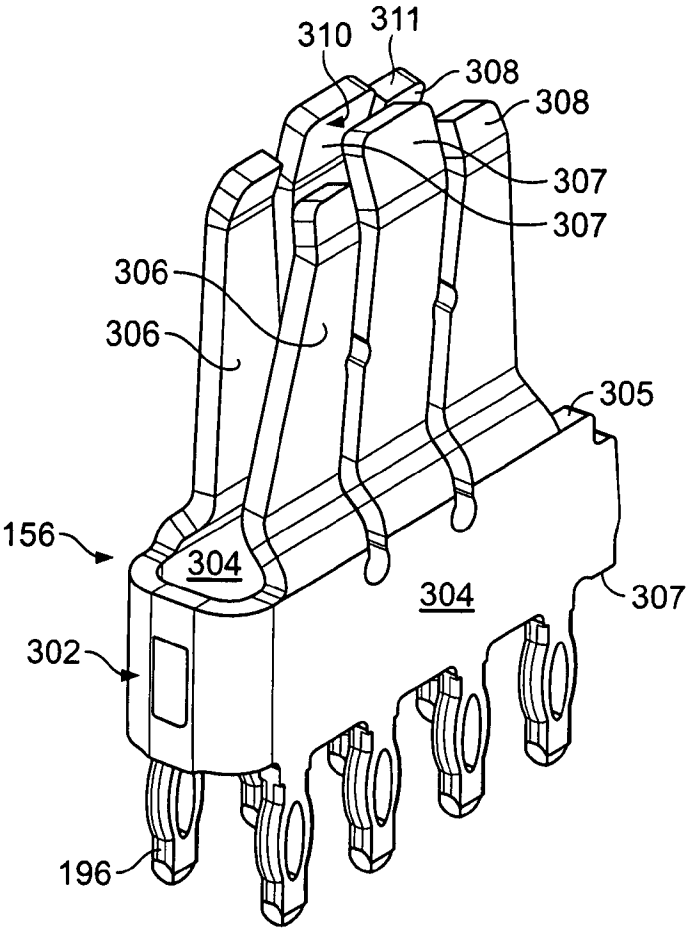
FIG. 7 illustrates an isometric view of a power contact with press-fit tails formed in accordance with an alternative embodiment of the present invention.

FIG. 7 illustrates a power contact 156 held within the central housing 112 of FIGS. 5 and 6. The power contact 156 includes a U-shaped body portion 302 having side sections 304 that are formed parallel with, and spaced apart from, one another. Lead edges 305 of the side sections 304 are formed integral with contact beams 306–308. Beams 306–308 are spaced-apart from one another by a gap 310. The side sections 304 also include trailing edges 307, from which contact tails 196 extend. In the example of FIG. 7, "eye of the needle" contact tails 196 are formed integral with the power contact 156, where the contact tails 196 are aligned in two parallel rows extending from the parallel side sections 304, although more or fewer contact tails 196 may be provided.

Figure 8:
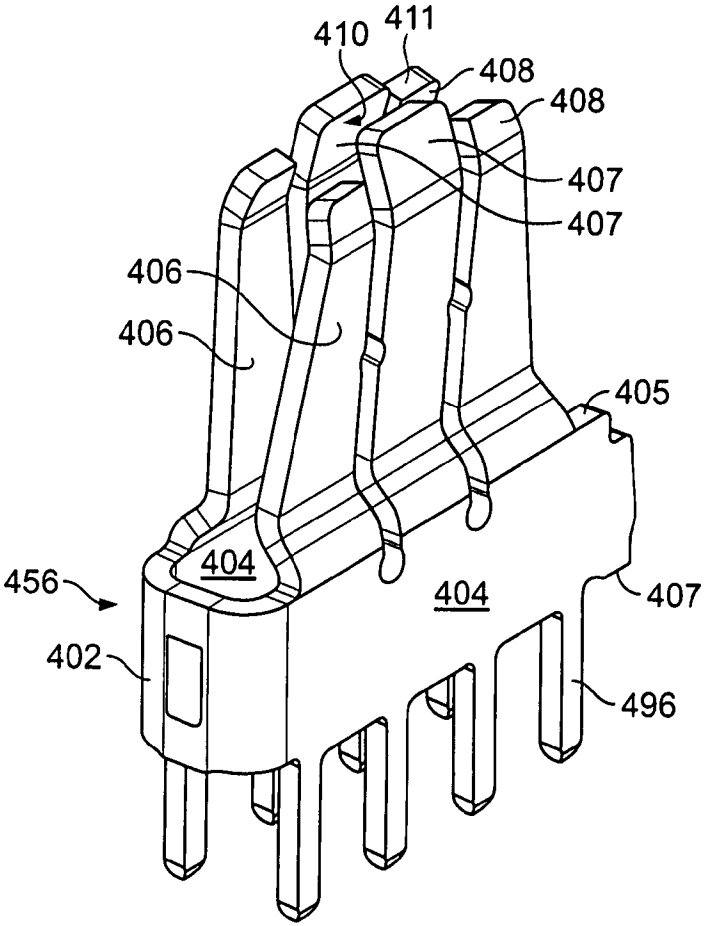
FIG. 8 illustrates an isometric view of a power contact with solder tails for use in accordance with an embodiment of the present invention.

FIG. 8 illustrates an alternative embodiment of a power contact 456 that may be utilized in a board mounting application. The power contact 456 includes a U-shaped body 402 having parallel and spaced-apart side sections 404. The side sections 404 have lead and trailing edges 405 and 407, respectively. The lead edge 405 of each side section 404 is formed integral with a series of contact beams 406–408, each of which has an outer tip 411. Contact beams 406–408 are spaced-apart by a gap 410. The trailing edge 407 is formed integral with pin contact tails 496 that are configured to be soldered into vias within a circuit board. The pin contact tails 496 have uniform square cross-sections and are arranged in parallel rows extending downward from corresponding side sections 404.

Figure 9:
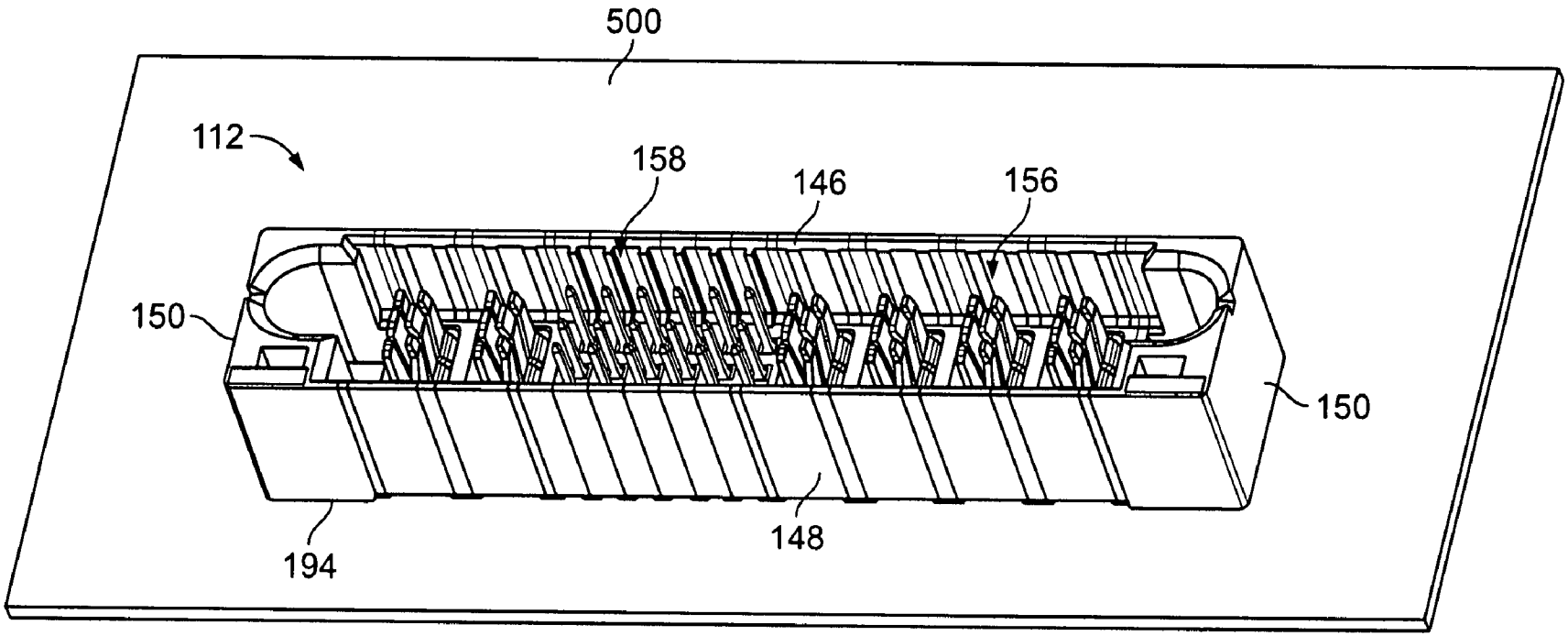
FIG. 9 illustrates a central housing having a contact pattern formed in accordance with an alternative embodiment of the present invention.

FIG. 9 illustrates the central housing 112 of FIGS. 3 and 4 as mounted to a circuit board 500. When mounted to the circuit board 500, the board mounting interface 194 is securely and directly abutted against the surface of the circuit board 500. In the board mounting application of FIG. 9, the outer shell 14 (FIG. 1) is entirely removed and a set of power and signal contacts 156 and 158 are loaded into the central housing 112 having contact tails that are configured to be board mounted (e.g., press-fit, soldered and the like).

Figure 10:
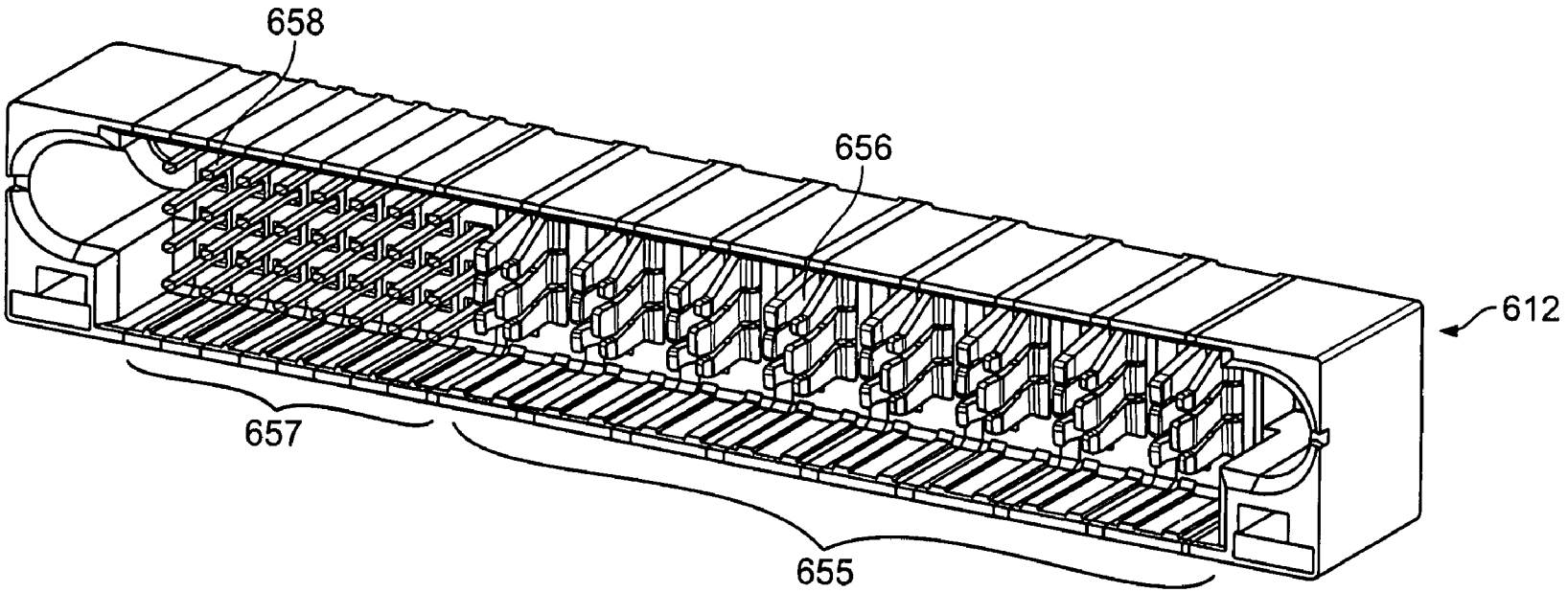
FIG. 10 illustrates a central housing in a board mounting application in accordance with an embodiment of the present invention.

FIG. 10 illustrates a central header 612 formed in accordance with an alternative embodiment. The central header 612 includes a different contact pattern such that the signal contacts 658 are all aligned at one end in a section denoted by bracket 657, while the power contacts 656 are all aligned at the opposite end in a common section denoted by bracket 655. By way of example, the configuration of FIG. 10 may represent thirty-two signal contacts arranged in a four by eight pattern, with eight power contacts.

The embodiments described provide various connector families, in which a common central housing may be utilized for different applications, such as board mounted applications and cable assembly applications. To be used in a board mounted application, the common central housing is loaded with a desired pattern of signal and power contacts having contact tails configured to be mounted a circuit board. The common central housing is then directly mounted to the circuit board at the circuit board interface formed on the rear surface of the central housing. When used in a cable assembly application, the common central housing is loaded with a different set of contacts, namely one configured to be joined directly to contact and signal wires. The central housing is then enclosed within an outer shell forming the outer housing of the cable connector. The contacts and outer shell also engage the cables to provide strain relief features.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments disclosed, but that the invention will include all embodiments falling within the scope of the appended claims.

What is claimed is:

1. A connector family for use in multiple applications, comprising:

a central housing having a connector mating face and a board mounting interface;

an outer shell shaped to fit over the central housing and at least partially enclosing the board mounting interface, and the outer shell having a cable interface configured to be joined to a cable; and contacts held in the central housing, the contacts, central housing and outer shell being used in different first and second configurations depending upon an intended one of first and second applications, wherein, in the first application the outer shell is mounted over the central housing to form the first configuration, and, in the second application the outer shell is removed to expose the board mounting interface on the central housing to form the second configuration.

2. The connector family of claim 1, wherein the central housing includes an interior cavity opening onto the connector mating face, the cavity having a back wall that holds the contacts, the contacts including contact tails that project from the board mounting interface.

3. The connector family of claim 1, wherein the connector mating face and board mounting interface are located on opposed front and back sides of the central housing.

4. The connector family of claim 1, wherein the outer shell includes a rear wall with openings therethrough, the rear wall being configured to cover the board mounting interface and to engage the cable to form a strain relief.

5. The connector family of claim 1, wherein the contacts include a first set of contacts having wire crimps and a second set of contacts having contact tails, the first set of contacts being provided in the central housing for use in the first application and not in the second application, the second set of contacts being provided in the central housing for use in the second application and not in the first application.

6. The connector family of claim 1, wherein the first application constitutes a cable assembly and the second application constitutes board mounting.

7. The connector family of claim 1, wherein the central housing includes an interior cavity with a back wall having contact retention openings therein, the contact retention openings being molded into one of different first and second patterns corresponding to the first and second applications, respectively.

8. The connector family of claim 1, wherein the central housing has a common outer envelope for use in both of the first and second applications.

9. The connector family of claim 1, wherein the connector mating face includes an interior cavity with an interior contour that is common for mating connectors in both of a cable assembly and board mounting connector that constitute the first and second applications, respectively.

10. A connector family intended for application as a cable assembly and as a board mounted connector, the family comprising:

contacts;

a central housing holding the contacts and having top, bottom and end walls that define an outer envelope of the central housing, the central housing having a connector mating face and a board mounting interface, the board mounting interface being configured to directly abut against a circuit board when used as a board mounted connector; and a removable outer shell provided over the central housing, the outer shell having an inner chamber shaped to fit about the outer envelope of the central housing, the outer shell at least partially enclosing the board mounting interface and at least partially exposing the connector mating face of the central housing, the outer shell having a rear wall configured to provide strain relief to a cable when used as a cable assembly.

11. The connector of claim 10, wherein the contacts are arranged in the central housing in different first and second patterns for the cable assembly and the board mounted connector.

12. The connector family of claim 10, wherein the outer shell has upper and lower half shells joined to enclose entirely the board mounting interface of the central housing.

13. The connector family of claim 10, wherein the connector mating face includes an interior cavity with an interior contour that is common for mating connectors in both of the board mounted connector and the cable assembly.

14. The connector family of claim 10, wherein the contacts include a first set of contacts having wire crimps configured to securely grip cables and a second set of contacts having contact tails configured to be secured to the circuit board, the first set of contacts being provided in the central housing for use in the cable assembly application and not in the board mounted application, the second set of contacts being provided in the central housing for use in the board mounted application and not in the cable assembly application.

15. The connector family of claim 10, wherein the central housing includes different first and second contact opening patterns defined by providing different corresponding sets of tool inserts into a mold used to form the central housing.

16. The connector family of claim 10, wherein the central housing includes attachment posts provided on at least one of the top and bottom walls, the attachment posts being received in holes in the outer shell.

17. The connector family of claim 10, wherein the central housing includes a back wall that is formed with a first contact pattern when used in the board mounted application, the back wall being formed with a different second contact pattern when used in the cable assembly application, the outer envelope of the central housing remaining common in both the board mounted and cable assembly applications.

* * * * *